US005989122A

United States Patent [19]

Roblejo

[11] Patent Number: 5,989,122

[45] Date of Patent: Nov. 23, 1999

[54] APPARATUS AND PROCESS FOR VERIFYING, SORTING, AND RANDOMIZING SETS OF PLAYING CARDS AND PROCESS FOR PLAYING CARD GAMES

[75] Inventor: Conrad Roblejo, Voorhees, N.J.

[73] Assignee: Casino Concepts, Inc., Berlin, N.J.

[21] Appl. No.: 08/778,667

[22] Filed: Jan. 3, 1997

[51] Int. Cl.[6] ..... A63F 1/14

[52] U.S. Cl. ..... 463/22; 463/11; 463/47; 273/149 R; 273/149 P

[58] Field of Search ..... 463/10, 11, 16, 463/22, 47; 273/148 A, 149 R, 149 P, 148 R, 292

[56] References Cited

U.S. PATENT DOCUMENTS

| | | | |
|---|---|---|---|
| 3,679,876 | 7/1972 | Faith et al. | 273/149 P |
| 4,534,562 | 8/1985 | Cuff et al. | 273/149 R |
| 4,586,712 | 5/1986 | Lorber et al. | 273/149 R |
| 4,662,637 | 5/1987 | Pfeiffer | 273/149 P |
| 4,667,959 | 5/1987 | Pfeiffer et al. | 273/149 R |
| 4,822,050 | 4/1989 | Normand et al. | 273/149 R |
| 5,067,713 | 11/1991 | Soules et al. | 273/149 P |
| 5,240,140 | 8/1993 | Huen | 273/149 P |
| 5,374,061 | 12/1994 | Albrecht | 273/149 R |
| 5,397,133 | 3/1995 | Penzias | 273/149 P |

*Primary Examiner*—Jessica J. Harrison
*Assistant Examiner*—James Schaaf
*Attorney, Agent, or Firm*—Schnader, Harrison, Segal & Lewis, LLP

[57] ABSTRACT

The invention relates to an apparatus for randomizing and verifying sets of playing cards. Also, the invention relates to a processing providing such an apparatus; feeding to the apparatus one or more cards either after they have been played in a game or from an unrandomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus.

22 Claims, 3 Drawing Sheets

APPARATUS AND PROCESS FOR VERIFYING, SORTING, AND RANDOMIZING SETS OF PLAYING CARDS AND PROCESS FOR PLAYING CARD GAMES

BACKGROUND OF THE INVENTION

1. Field of the Invention

This invention relates to the field of playing card shuffling apparatus and methods.

2. Description of the Prior Art

Soules, et al., U.S. Pat. No. 5,169,155, shows playing cards having invisible marking codes on the front surface adapted to be read by electro-optical reading means which identifies the card and gives an audio or visual signal to identify the player position to whom the card is to be manually dealt. This device is primarily adapted for the game of "Duplicate Bridge."

Kelley U.S. Pat. No. 5,431,399, shows a playing card distribution device comprising a set of photocells to sample the card indicia, displacement means powered by a motor, a processor control means to determine into which direction or holding receptacle the card is to be displaced, and program cards coded to indicate the distribution of the cards to the players. This device is especially useful for Duplicate Bridge games wherein the specific distributions to each of several tables of four bridge players are achieved. This device comprises a stepping motor, a distribution chute, a series of holding trays, and a processor which uses the identification information to align the distribution chute with the desired holding tray so that the card is propelled into that tray.

Albrecht U.S. Pat. No. 5,374,061, shows a blackjack shoe having means to read specially coded playing cards and send the coded information to a processor which determines a running count, betting count, true count, and other information related to the profitability of a particular wager or particular action such as an insurance bet, and whether the card belongs to the particular set of cards assigned to the table. If an improper card is detected, an alarm signal is generated.

U.S. Pat. No. 4,951,950, shows a playing card dealing device for dealing programmed deals comprising specially coded playing cards, electrical means for reading the coded playing cards, and indicator means for indicating which player a particular card should be dealt.

Miller, U.S. Pat. No. 5,362,053, shows a device for speeding the game of blackjack comprising specially coded playing cards, a reader such as a bar code reader, and means for allowing the dealer to determine the value of the down card. The device is adapted to indicate whether the blackjack dealer's down card is an ace, whether his up card has a value of 10, or has a value of 10 when his up card is an ace.

Normand, et al., U.S. Pat. No. 4,822,050, shows a device for distributing specially coded playing cards among four receiving boxes so as to create bridge hands according to a controlled, predetermined pattern.

Soules, et al., U.S. Pat. No. 5,067,713, shows a device for reading bar codes on special playing cards and to deal a preselected "deal" to a chosen number of players by indicating to the human dealer the direction each card is to be dealt.

Plevyuk et al, U.S. Pat. No. 4,832,342, shows a processor controlled shuffling machine which comprises a revolving wheel having a plurality of receiving positions, wherein the positions in the revolving wheel are aligned with a feeding mechanism and the wheel is rotated so as to cause the playing cards to be received in the receiving positions in a random order, and thereafter ejected into a stack forming a shuffled deck. Plevyuk et al do not disclose a method of reading indicia on playing cards prior to randomizing. Furthermore, Plevyuk et al do not show a means or method of verifying the accuracy of a deck of playing cards.

None of the prior art devices has become widely accepted in the field of casinos. In casinos, especially in connection with casino blackjack games, the conventional practice is to spread out one or more, usually up to eight, fresh decks of cards at the beginning of a shift and to determine that the deck or decks contain each and every card which belongs to those decks, and no additional cards. It is also the practice to stop the game when a point in a collection of decks, known as a "shoe," is reached, and to manually and extensively shuffle the set of cards comprising one or more decks. These conventional practices are very time consuming, delay the momentum of the game, and sometimes give an opportunity for fraudulent practices, especially on the part of dealers who may be working with player-partners.

It is an object of this invention to provide an apparatus and method for receiving cards, either from new decks or after the cards have been played, to shuffle the cards in a randomized order, and simultaneously to verify the accuracy of the set or sets of cards in the deck or decks.

SUMMARY OF THE INVENTION

These objects, and others which will become apparent from the following disclosure, are achieved by the present invention which comprises, in one aspect, an apparatus for randomizing and verifying sets of playing cards comprising:

A. control means;

B. input means for receiving playing cards into the apparatus;

C. identification means for reading indicia on the playing cards;

D. buffer means having a plurality of slots for temporarily holding cards;

E. directing means for directing cards from the input means into slots in the buffer means;

F. transporting means for moving cards from the input means to and through the identification means;

G. stacking means;

H. ejecting means for ejecting cards from the slots in the buffer means into the stacking means; the apparatus adapted to verify that a true set of cards has been received in the input means and to deliver a true set of cards at the stacking means in either a random order or a sorted order.

In another aspect, the invention comprises a process comprising providing such an apparatus; feeding to the input means one or more cards either after they have been played in a game or from an unrandomized or unverified set; and manually retrieving a verified true set of cards from the stacking means.

A further aspect of the invention is a process of playing in a casino setting or simulated casino setting a card game comprising providing such an apparatus, feeding unverified sets of playing cards to the input means, and recovering verified true sets of cards from the stacking means.

BRIEF DESCRIPTION OF THE DRAWINGS

The foregoing and additional objects and advantages of the invention will be best understood by reference to the following detailed description, accompanied by the schematic illustrations of preferred embodiments of the invention in which.

DETAILED DESCRIPTION OF INVENTION AND PREFERRED EMBODIMENTS

Figure 1:
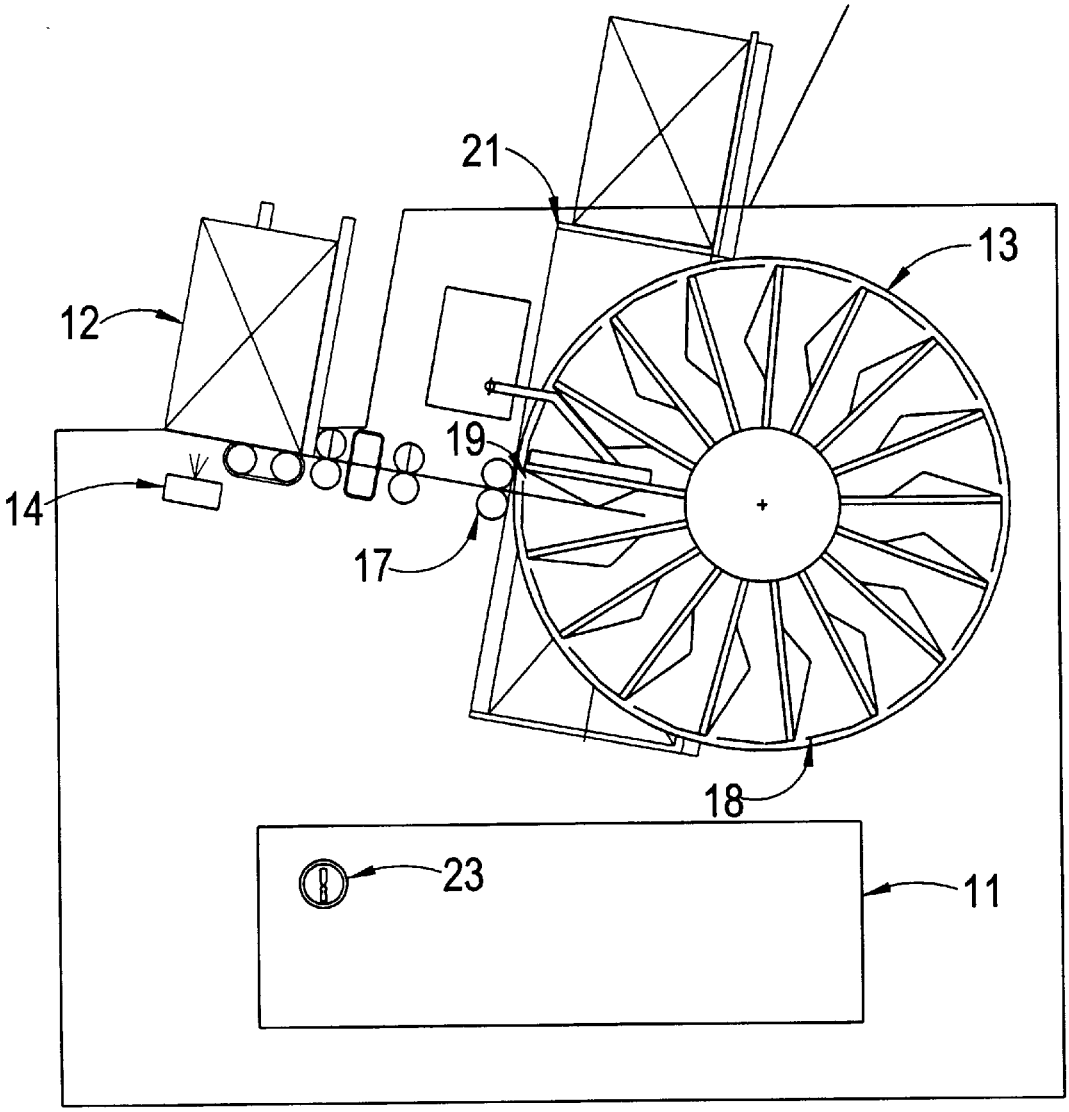
FIG. 1 is a side cross-sectional view of an embodiment of an apparatus according to the invention.

According to an embodiment of the invention, an apparatus 10 comprising control means 11, input means for receiving playing cards, illustrated as input stack holder 12, buffer means having a plurality of slots for temporarily holding cards, illustrated as a wheel 13 having a plurality of slots 18; identification means for reading indicia, illustrated as bar code reader 14 to determine identity of playing cards 16 which can be specially marked with bar codes 16A or other coded information, or can be unmarked; a transporting means, illustrated as conveyer 17, for transporting playing cards from said stack holder 12 for receiving playing cards to said reader 14 for reading indicia on playing cards to determine the identity of each card and thereafter to a slot 18 in said wheel 13; directing means illustrated as a motor to rotate the sorting wheel to align a slot selected by said control means with said means for transporting so that a card may be directed into said selected slot 19; ejecting means 20 (FIG. 2) for ejecting cards from said slots 18 in said wheel 13 in an order controlled by said control means 11; stacking means 21 for receiving cards ejected from slots 18 in the order in which they are ejected; the control means 11 adapted to (i) determine whether a complete set of cards has been identified by the reader 14 for reading indicia; and (ii) either randomize the order of cards ejected into said means for receiving said cards ejected from said slots in the order in which they are ejected, or sort the cards into "new deck" order.

The stacking means for receiving cards ejected from the slots is preferentially an elevator which is adapted to move, upon signal from said control means, a verified and randomized set of received cards to a position where they can be manually retrieved.

Figure 2:
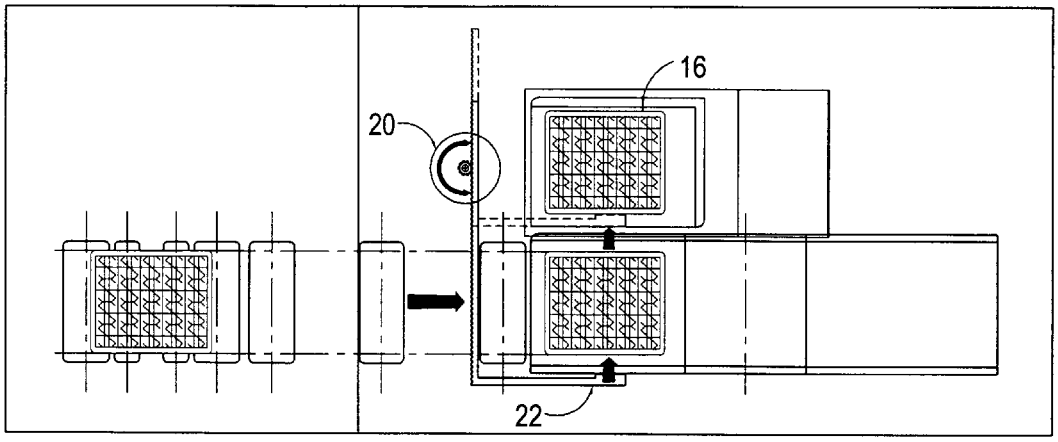
FIG. 2 is a top cross-sectional view of a section of the apparatus illustrating an ejecting mechanism according to the invention.
Figure 3A:
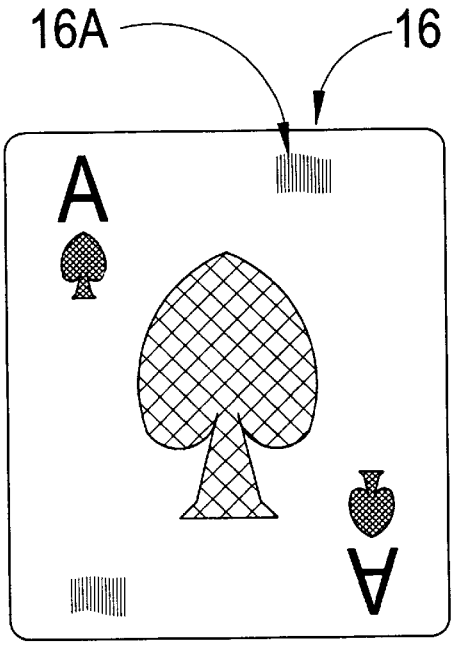
FIGS. 3A and 3B are, respectively, a top plan of the front and back of a playing card used in the apparatus and process.
Figure 3B:
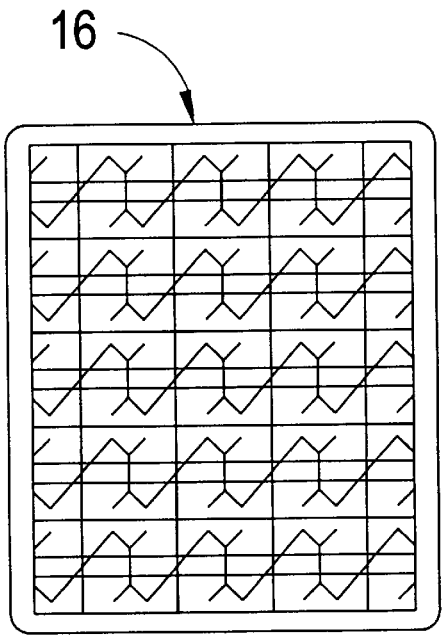

FIG. 2 shows an ejecting mechanism 20 for ejecting cards from the slots in the order controlled by said control means preferentially comprises a pusher 22 adapted to push a card from a selected slot sideways onto the mechanism for receiving cards 16.

Preferably, the control means is a computer comprising a microprocessor programmed to receive information from the means for reading indicia, determine the identity of a card based on the information, compare the identity of the card to a list of cards in a set, generate a random order of cards in the set, control the alignment of slots in the sorting wheel so that cards will be received in the wheel and/or ejected from the wheel in the random order, and to signal an event of determination of identity of a card which does not belong to the set, and if the event does not occur, signal an elevator to move a verified and randomized set of received cards to a position where they can be manually retrieved. The preferred control means comprises a Motorola 68HC16 microprocessor. Also suitable are the X86 microprocessors made by Intel and others.

The means for reading indicia is preferably either a bar code reader, video optical system, optical scanner, reader of hologram information, or reader of magnetic indicia.

The set preferably consists of one or more decks, and in one preferred embodiment from 1 to 10 decks each of which has an array of cards customary for the card game being played. Suitable decks include, for example, blackjack decks, Pan-9 decks, Carribean stud decks, California blackjack decks, or super-pan-Pan-9 decks. For example, in blackjack there are 52 cards, 2 through ace in each of the four suits, clubs, diamonds, spades, and hearts. The apparatus and process of the invention verifies that the set of one or more decks which is processed is complete and accurate; otherwise, when an incorrect set is determined, the apparatus sends a signal, either audible, visual, to a network administrator, by ejecting a card which does not belong in the set, or by any other means to indicate an inaccurate deck.

The illustrated transporting means comprises one or more motor-driven friction rollers and a conveyer between the means for receiving playing cards and the means for reading indicia and the selected slot position of the sorting wheel.

Preferred embodiments comprise a key locking means 23 adapted to signal its locked or unlocked status to the control means, and the control means is adapted to operate the apparatus only when the locking means is in an unlocked status. The apparatus is also controlled to allow for manual retrieval of all cards retained within the apparatus in the event that the locking means is in a locked status.

In some embodiments, it is desirable to connect the apparatus through the microprocessor to a network controller and to send and receive information to and from the network controller regarding locked status and number of cards or sets of cards determined to be complete or incomplete sets. The apparatus may also include means to determine the physical integrity of cards, the physical integrity comprising one or more factors selected from bent, torn, nicked, and marked, and optionally including means to physically eject any card determined to lack the physical integrity. The apparatus may also be adapted to print or direct a printer to print verification dated.

While the invention has been described in detail with respect to certain preferred and alternative embodiments, other embodiments and features should become apparent to those skilled in this art without departing from the spirit and scope of the invention as set forth in the following claims.

What is claimed is:

1. Apparatus for verifying and sorting or shuffling sets of playing cards comprising:

A. control means;

B. input means for receiving playing cards into the apparatus;

C. identification means for reading indicia on the playing cards;

D. buffer means having a plurality of slots for temporarily holding cards;

E. directing means for directing cards from the input means into slots in the buffer means;

F. transporting means for moving cards from the input means to and through the identification means;

G. stacking means;

H. ejecting means for ejecting cards from the slots in the buffer means into the stacking means; wherein the identification means signals to the control means the identities of the cards and wherein the control means verifies that a true set of cards has been received in the input means and directs the ejecting means to deliver a true set of cards at the stacking means in either a random order or a sorted order.

2. Apparatus according to claim 1 wherein the identification means comprises a reader adapted to read identifying information on the face of the cards.

3. Apparatus according to claim 1 wherein the stacking means is an elevator driven by a motor controlled by the control means to move between a first position where cards ejected from the buffer means are received to a second position where a stack of the ejected cards can be retrieved by a human operator or dealer.

4. Apparatus according to claim 3 wherein the control means is adapted to cause the elevator to move to the second position only when a true set or deck is identified.

5. Apparatus according to claim 1 wherein the ejecting means comprises a pusher adapted to push a card from a selected slot sideways onto or into the stacking means.

6. Apparatus according to claim 1 wherein the control means is a computer processor or microprocessor programmed to receive information from the identification means, determine the identity of each card based on the received information, compare the identity of each card to a list of cards in a true set, generate an order of cards in the true set, control the alignment of slots in the buffer means with the directing means so that cards will be received or ejected from the slots in the order generated by the control means, said generated order being either a pseudo-random order, a random order or a sorted order.

7. Apparatus according to claim 6 further including visual and/or audible signal means and wherein said control means is also adapted to direct a visual or audible signal upon identification of a card which does not belong to a true set or deck, and/or upon determination that a card is missing from a true set or deck after all of the cards received in the input means have been identified.

8. Apparatus according to claim 1 wherein the buffer means is a wheel or elevator operated by a motor controlled by the control means.

9. Apparatus according to claim 1 wherein said means for reading indicia is selected from the group consisting of a bar code reader, optical scanner, reader of magnetic indicia, or reader of holograms.

10. Apparatus according to claim 1 wherein said set consists of one or more blackjack decks, Pan-9 decks, Caribbean stud decks, California blackjack decks, or super-pan-9 decks.

11. Apparatus according to claim 1 wherein the transporting means comprises one or more motor-driven friction rollers and a conveyer.

12. Apparatus according to claim 1 wherein the control means comprises a 68HC16 or X86 microprocessor.

13. Apparatus according to claim 8 further including a mechanical and/or electrical locking means adapted to signal its locked or unlocked status to the control means, the control means adapted to cause the elevator to remain in the first position when the locking means is in a locked status.

14. Apparatus according to claim 1 wherein the said control means is connected to a network controller and is adapted to send and receive information to and from the network controller regarding locked/unlocked status and/or number of cards or sets of cards determined to be complete or incomplete sets.

15. Apparatus according to claim 1 wherein the buffer means is a sorting wheel and the directing means comprises a motor adapted to rotate the sorting wheel to align a slot selected by the control means with the transporting means so that a card may be directed into the selected slot.

16. Apparatus according to claim 1 further including means to determine the physical integrity of cards, the physical integrity comprising one or more factors selected from bent, torn, nicked, and marked, and optionally including means to physically eject any card determined to lack the physical integrity.

17. Apparatus according to claim 1 wherein the true set is delivered at the stacking means in a sorted order which is the same order and consists of the same cards as found in new fresh decks.

18. Apparatus according to claim 1, wherein the true set is delivered at the stacking means is adapted to generate a new random order each time a set of cards is introduced to the control means, the set comprising from 1 to 10 decks.

19. Apparatus according to claim 1 adapted to print or direct a printer to print verification data.

20. Process of verifying sets of playing cards comprising:

A. providing an apparatus according to claim 1;

B. feeding to the input means one or more cards either after they have been played in a game or from an unrandomized or unverified set;

C. manually retrieving a verified true set of cards from the stacking means.

21. Process of playing in a casino setting or simulated casino setting a card game comprising providing an apparatus according to claim 1, feeding unverified sets of playing cards to the input means, and recovering verified true sets of cards from the stacking means.

22. Process according to claim 21 further including providing playing cards which are specially coded with either bar coding or hologram indicia indicating the value and suit of each playing card.

* * * * *